US006065477A

United States Patent [19]

Doo

[11] Patent Number: 6,065,477

[45] Date of Patent: May 23, 2000

[54] MANICURE CONTAINER

[76] Inventor: An Suck Doo, 158-63 Annyong-Ri, Taean-Ub, Hwasung-Gun, Kyungki-Do, 445-970, Rep. of Korea

[21] Appl. No.: 09/227,424

[22] Filed: Jan. 8, 1999

[30] Foreign Application Priority Data

Jan. 24, 1998 [KR] Rep. of Korea ..... 98-871
Feb. 11, 1998 [KR] Rep. of Korea ..... 98-21205

[51] Int. Cl.[7] ..... A45D 29/00; A45D 29/18; A45D 29/20; A46B 11/00

[52] U.S. Cl. ..... 132/73; 132/74.5; 132/75; 401/126

[58] Field of Search ..... 132/73, 74.5, 75, 132/73.5, 309, 329; 401/126, 37, 129

[56] References Cited

U.S. PATENT DOCUMENTS

| | | | |
|---|---|---|---|
| 1,955,419 | 4/1934 | Gerard | 132/74.5 |
| 2,046,002 | 6/1936 | Hunter | 132/74.5 |
| 2,888,020 | 5/1959 | Schulz | 132/74.5 |
| 4,522,523 | 6/1985 | Vogelsang | 401/126 |
| 5,397,195 | 3/1995 | Goncalves | 401/277 |
| 5,746,529 | 5/1998 | Peters et al. | 401/126 |
| 5,762,077 | 12/1999 | Griffiths | 132/74.5 |
| 6,004,055 | 12/1999 | Cheng | 401/126 |

*Primary Examiner*—John J. Wilson
*Assistant Examiner*—Robyn Kieu Doan
*Attorney, Agent, or Firm*—Vidas, Arrett & Steinkraus P.A.

[57] ABSTRACT

The present invention relates to a manicure container which enables a variety of paintings and drawings on fingernails or toenails by incorporating both a brush type painting applicator and a pen type drawing applicator in a same container.

2 Claims, 6 Drawing Sheets

MANICURE CONTAINER

FIELD OF THE INVENTION

The present invention relates to a manicure container which stores manicure liquid(enamel or nail color) mainly to be applied on the fingernails or toenails of women for beauty and which has a tool to apply the same liquid and specifically to a manicure container which holds the combination of a painting applicator in the form of brush and a drawing applicator in the form of pen in the same container to allow a variety of painting and drawing.

BACKGROUND OF THE INVENTION

Generally a conventional manicure container is constituted of a bottle 100 for containing manicure liquid 300, which bottle has a neck 110 formed with a thread portion 111 in the top region, wherein a threaded portion 211 to be screwed in the threaded portion 111 of said neck 110 is provided on a cover and handle 200, in the middle of which there is provided a carrier rod 210 having a brush 220 on the lower end as shown in FIG. 1.

Such a manicure container is kept tight by the handle 200, which is screwed in the bottle 100 holding manicure liquid, and is opened by turning the handle when use is intended and the brush 220 drenched with the manicure liquid 300, carried on the upwardly withdrawn handle, is used for practical manicuring.

However, the conventional applicator mentioned above has only the function of painting nails due to the limited function of the brush 200 and therefore was not sufficient to meet the various aesthetic desire of the user.

SUMMARY OF THE INVENTION

The present invention which was created therefore to resolve the drawback of the conventional art as described above has the object to provide a manicure container having an applicator for two discrete purposes of painting and drawing on one side of the container in order to fill the consumer's variety of aesthetic desire.

The above object of the present invention is achieved by a manicure container, which comprises a tube container of nylon resin for holding manicure liquid, said container having an opening section with a thread on the top region of the container and being thereunder formed with a peripheral groove for guidedly retaining the air bubbles generated from the inside of the container;

a nozzle having a threaded section internally for engagement with said thread, having a knurling section on its lower circumferential area, and having an engaging rib on its upper circumference of smaller diameter at a predetermined level, vertical spline grooves being formed around the circumference above the location of said rib, and also having a small end section of further smaller diameter above the splined section, a hole being formed on the top tip of the nozzle;

a nozzle with a threaded section internally for engagement with said thread, with a knurling section on its lower circumferential area, with an upper intermediate section of smaller diameter formed with an engaging rib at a predetermined level around its outer circumference, vertical spline grooves being formed around the surface above the location of said rib, and with a small end section of further smaller diameter above the splined section, formed with a hole on its top tip;

a manicure supplying tube assembly having a carrier tube with a brush at its lower end and having slit openings formed around the periphery of carrier tube below the flange, said carrier tube being provided in the central region of said flange, said flange being interlocked with the inside of said nozzle;

an intermediate nozzle so arranged as to project into the bore of said nozzle, said intermediate nozzle being inserted on the top projection of said supplying tube assembly and having a tube of Φ0.6 mm for use as a pen at the top end; and a cover having small projections at a constant interval circumferentially around its internal periphery to engage with said engaging rib of the nozzle by riding over the rib, having spline projections extending upward on the internal area of the cover to be guided by said spline grooves, one out of a certain number of said spline projections extending upward, in a varied enlarged size, on the location of said small end section to guide said small end section, and having housings formed centrally on its base to seal tight said top tip of the nozzle and the tube.

In addition, the container may be formed with a ball on the outer surface of the bottom to cause a ball joint with a sucking plate.

BRIEF DESCRIPTION OF THE INVENTION

FIG. 1 shows an exploded perspective view of a manicure container according to a conventional art, FIG. 2 shows an exploded perspective view of a manicure container according to an embodiment of the invention, FIG. 3 shows a longitudinal cross section of a manicure container according to an embodiment of the invention, FIG. 4*a* shows an exploded perspective view of a manicure container according to an embodiment of the invention illustrating the sate in use for painting, FIG. 4*b* shows a perspective view of a manicure container according to an embodiment of the invention illustrating the sate in use for drawing and FIG. 5 shows an enlarged view of essential part of the present invention in cross section.

DESCRIPTION OF THE EMBODIMENT

The present invention will be explained below with reference to a preferred embodiment in conjunction with the attached drawings.

The same or equivalent parts as in the conventional art presented above will be given the same number.

Figure 1:
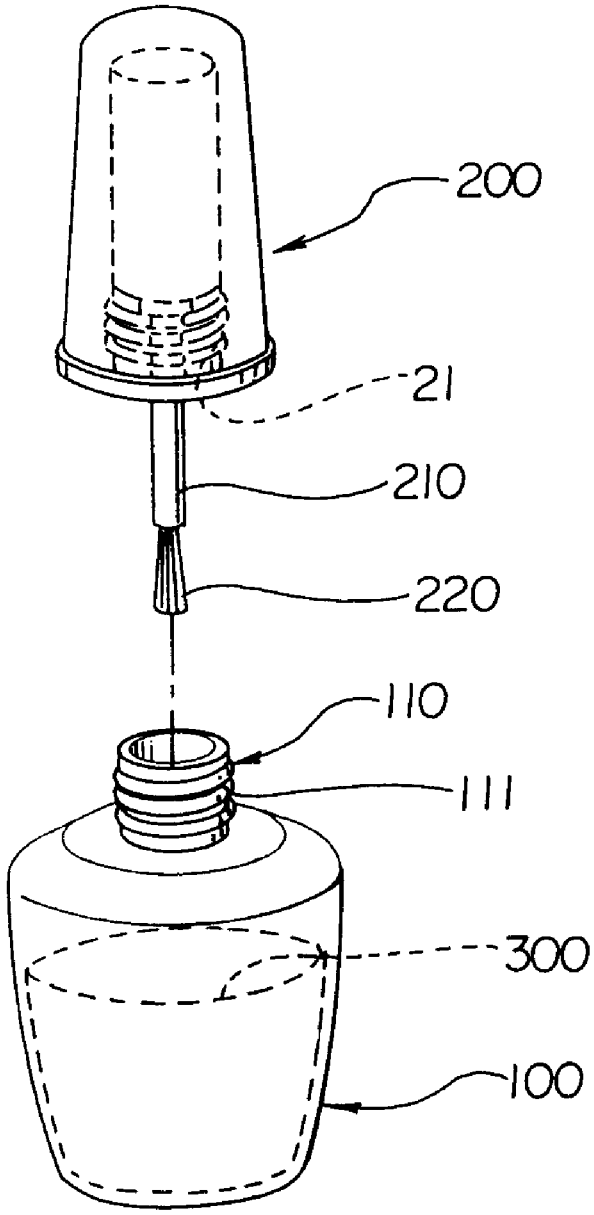
Figure 2:
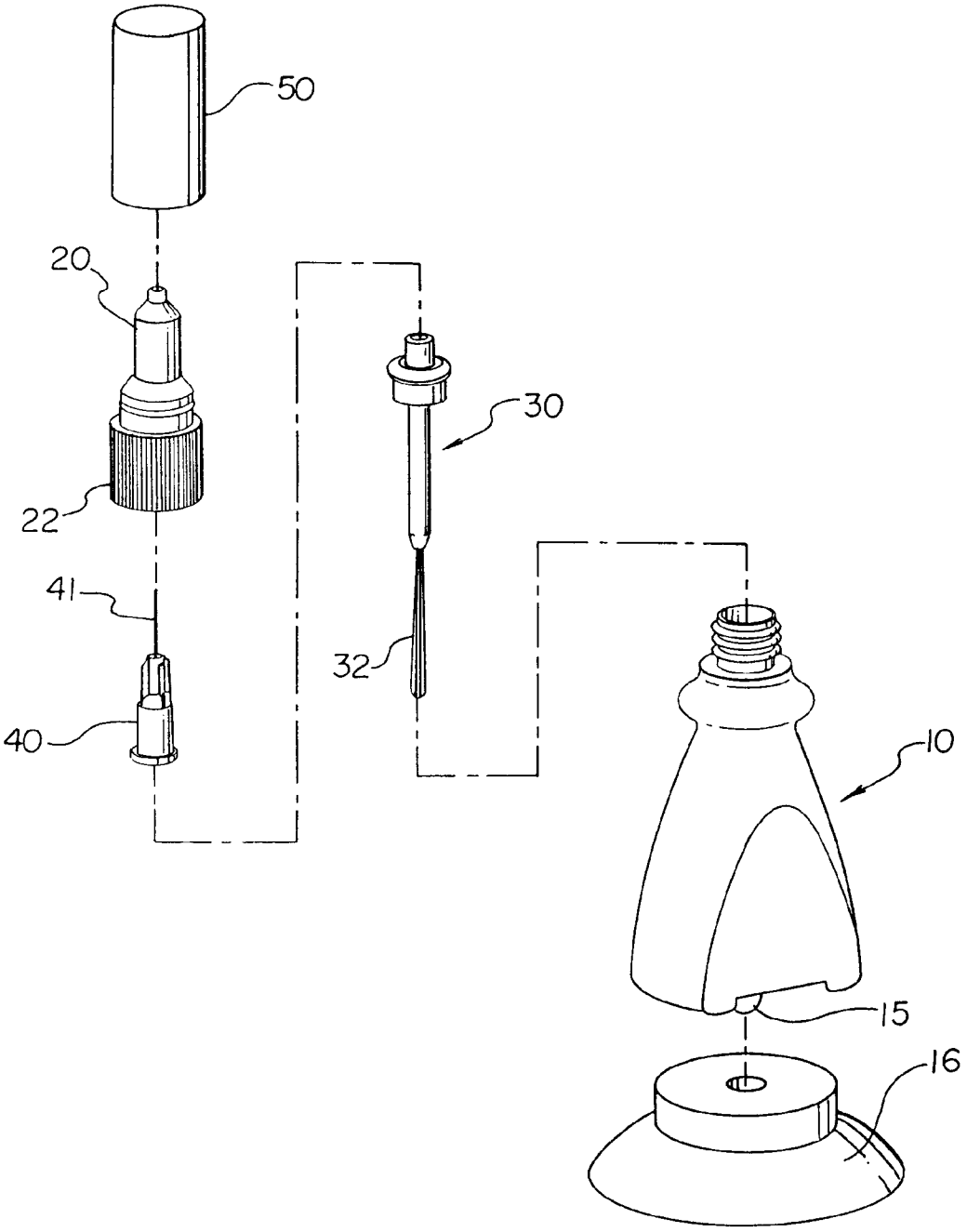
Figure 3A:
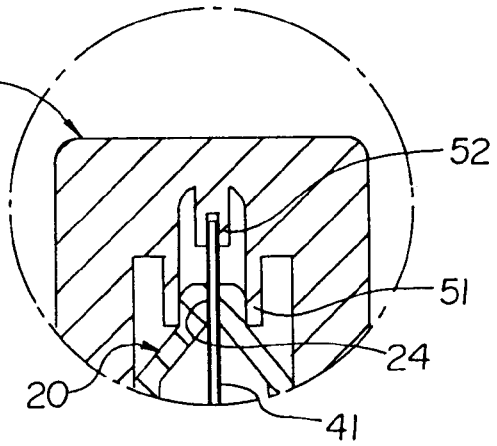
Figure 3:
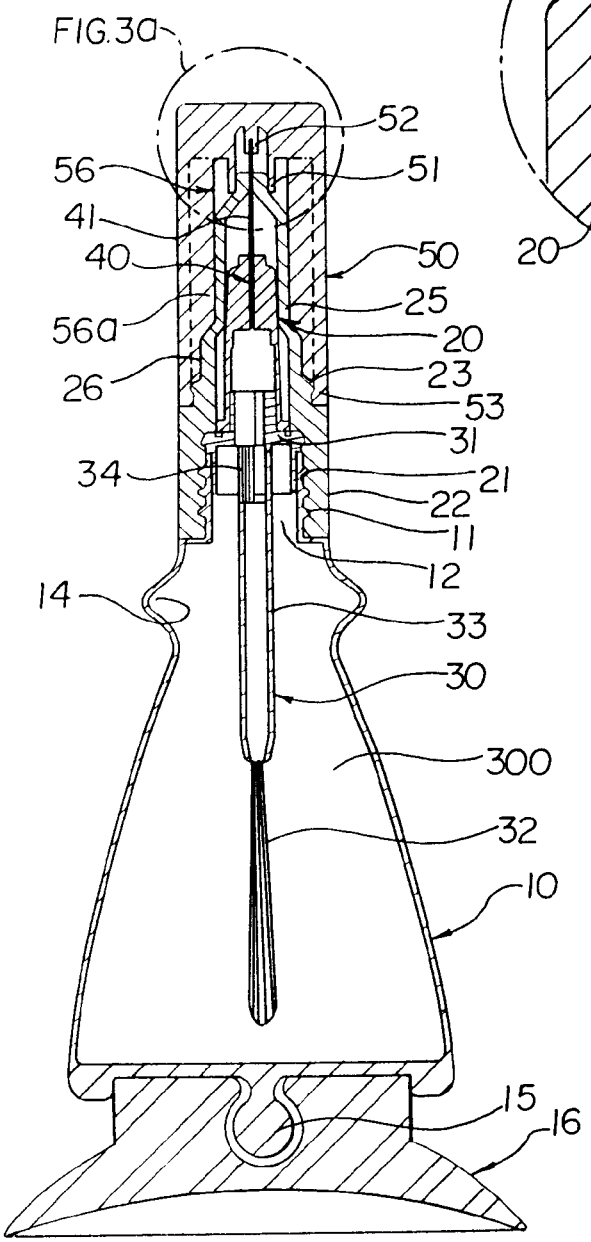

Particularly in FIGS. 2 and 3, there is shown a manicure container, which comprises a tube container 10 of nylon resin for holding manicure liquid, said container having an opening section 12 with a thread 11 on the top region of the container 10 and being thereunder formed with a peripheral groove 14 for guidedly retaining the air bubbles generated from the inside of the container 10;

a nozzle 20 having a threaded section 21 internally for engagement with said thread 11, having a knurling section 22 in its lower surrounding area, and having an engaging rib 23 on the upper periphery with a diameter smaller than that of said knurling section and at a predetermined level, vertical spline grooves 26 being formed around the circumference above the location of said rib, and also having a small end section 25 of further smaller diameter above the splined section, a hole 24 being formed on the top tip of the nozzle for insertion of the tube of the intermediate nozzle;

a manicure supplying tube assembly 30 having a carrier tube 33 with a brush 32 at its lower end and having slit openings 34 formed around the periphery of carrier tube 33 below the flange 31, said carrier tube being provided in the central region of said flange, said flange being interlocked with the inside of said nozzle;

an intermediate nozzle 40 so arranged as to project into the bore 24 of the nozzle 20, said intermediate nozzle being inserted on the top projection of the supplying tube assembly 30 and having a tube 41 with a diameter of 0.6 mm for use as a pen at the top end; and a cover 50 having small projections 53 at a constant interval circumferentially around its internal periphery to engage with said engaging rib 23 of the nozzle 20 by riding over the rib, having spline projections 56 extending upward on the internal area of the cover to be guided by said spline grooves 26, one out of a certain number of said spline projections extending upward, as a respective enlarged portion 56A, on the location of said small end section 25 to guide said small end section, and having housings 51 and 52 formed centrally on its base to seal tight said top tip of the nozzle 20 and the tube 41.

In addition, the container 10 may be formed with a ball 15 on the outer surface of the bottom to cause a ball joint with a sucking plate 16.

The invention constructed as the above is operated as the following.

As can be seen in FIG. 3, the tube container 10 according to the invention, which contains manicure liquid 300, is kept with the opening 12 closed.

Then, when it is intended to care for the fingernail, if cover 50 with a relatively long length is gripped and twisted, the rotation force of the cover 50 can be directly transmitted into the nozzle 20 due to the spline engagement of the cover 50 and the nozzle 20, therefore the cover 50 integrally combined with the nozzle 20 can be separated from the thread 11 of the opening section 12 of the container 10.

Figure 4A:
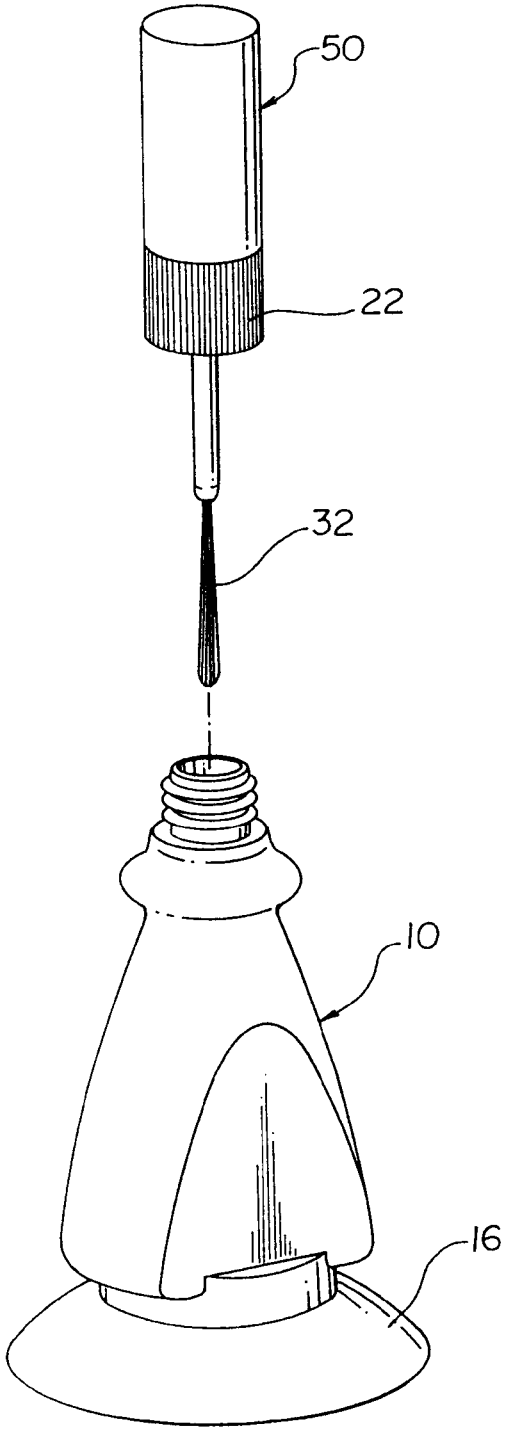

Thereafter, the brush 32 wet with manicure liquid can be used to paint on fingernails or toenails in a state shown in FIG. 4*a*, as in a usual conventional operation.

On the other hand, an important function of the present invention, that is, the use of the present device like a kind of cosmetic pen is explained below.

Figure 4B:
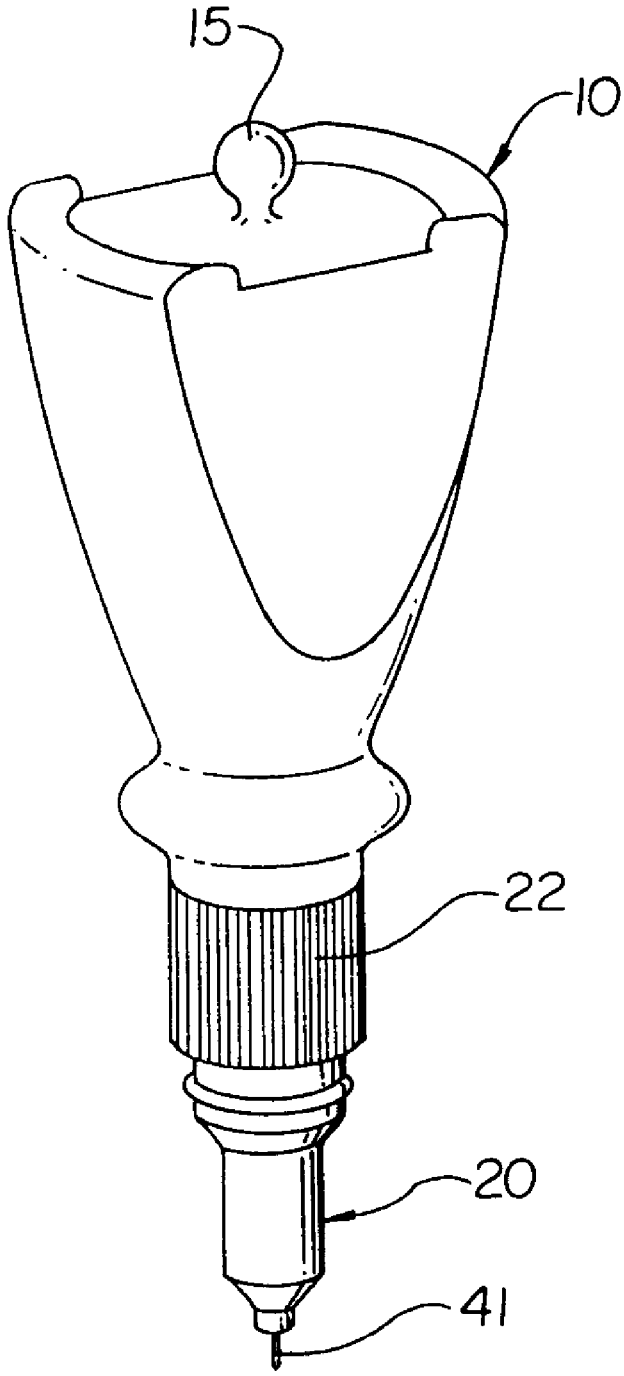
Figure 5:
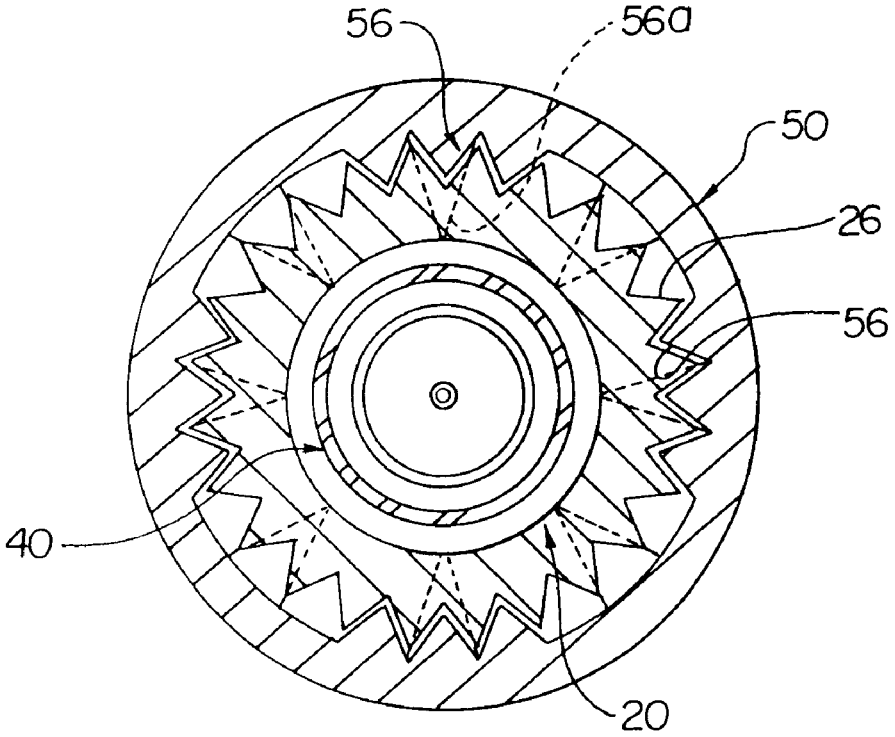

When, from the state in which as described above in connection with FIG. 3, the combination of the nozzle 20 and the cover 30 for the purpose of painting with the brush 32 is kept closed in the container 10, only the cover 50 is withdrawn upward, the spline engagement of the cover 50 and the nozzle 20 is released as the small projections 53 of the cover 50 positioned below the rib 23 ride over the rib 23 due to flexible property of the plastic, whereby there is obtained an applicator for use as a pen in drawing, as shown in FIG. 4*b*.

Describing the operation in detail, when in the state as shown in FIG. 3 and particularly FIG. 4*b*, the tube container 10 is held firmly with a thumb and an index finger and is given a finger pressure, then the manicure liquid 300 inside the tube container 10 is caused to flow through the slit openings 34 positioned inside the nozzle 20, leaving the supplying tube 30 and enter the intermediate nozzle 40 to eject from the tube 41, so that the user can use the discharging manicure liquid to make a drawing as desired on the nails with the help of the exposed tip of the tube as a pen.

The peripheral groove 14 forming a ridge is originally intended to capture the air bubble which may evolve during the use but the structure can contribute to writing convenience.

As the finger pressure and the bubble forming depend on the viscosity or other properties of the manicure liquid 300, adjustment of the physical property for the manicure liquid is important.

It is preferable that the container 10 is kept with the ball 15 joined in a sucking plate 16, which is fixed at a certain convenient place, before the container is removed for use by disconnecting the ball from the sucking plate.

In the present invention, while the container assembly is not in practical use, the housings 51 and 52 act to seal the volatile manicure liquid 300 air- tight from the intermediate nozzle 40 and tube 41 and the spline projections 56 and their enlarged portions 56A formed on the inside of the cover 50 have the function of guiding the nozzle 20 and tube 41 to prevent them from contacting flat with the internal wall of the cover and thus from breaking between an opening and closing of the cover.

The present invention constructed and operated as described above has the advantage of rendering a variety of aesthetic expression in a beauty art by combining together the function of painting and that of drawing in a single manicure container in stead of the conventional function of mere painting.

What is claimed is:

1. A manicure container, which comprises:

a tube container (10) of nylon resin for holding manicure liquid, said container having an opening section (12) with a thread (11) on the top region of the container (10) and being thereunder formed with a peripheral groove (14) for guidedly retaining the air bubbles generated from the inside of the container (10);

a nozzle (20) having a threaded section (21) internally for engagement with said thread (11), having a knurling section (22) in its lower surrounding area, and having an engaging rib (23) on the upper periphery with a diameter smaller than that of said knurling section and at a predetermined level, vertical spline grooves (26) being formed around the circumference above the location of said rib, and also having a small end section (25) of further smaller diameter above the splined section, a hole (24) being formed on the top tip of the nozzle for insertion of the tube of the intermediate nozzle;

a manicure supplying tube assembly (30) having a carrier tube (33) with a brush (32) at its lower end and having slit openings (34) formed around the periphery of carrier tube (33) below the flange (31), said carrier tube being provided in the central region of said flange, said flange being interlocked with the inside of said nozzle;

an intermediate nozzle (40) so arranged as to project into the bore (24) of the nozzle (20), said intermediate nozzle being inserted on the top projection of the supplying tube assembly (30) and having a tube (41) with a diameter of 0.6 mm for use as a pen at the top end; and a cover (50) having small projections (53) at a constant interval circumferentially around its internal periphery to engage with said engaging rib (23) of the nozzle (20) by riding over the rib, having spline projections (56) extending upward on the internal area of the cover to be guided by said spline grooves (26), one out of a certain number of said spline projections extending upward, as a respective enlarged portion (56A), on the location of said small end section (25) to guide said small end section, and having housings (51) and (52) formed centrally on its base to seal tight said top tip of the nozzle (20) and the tube (41).

2. A manicure container according to claim 1, wherein the container (10) is formed with a ball (15) on the outer surface of the bottom to form a ball joint connection with a sucking plate (16).

* * * * *